US006281909B1

(12) United States Patent
Fassler et al.

(10) Patent No.: US 6,281,909 B1
(45) **Date of Patent: *Aug. 28, 2001**

(54) CLEANING ORIFICES IN INK JET PRINTING APPARATUS

(75) Inventors: Werner Fassler; John E. Mooney, both of Rochester; Marcello D. Fiscella; Ravi Sharma, both of Fairport, all of NY (US)

(73) Assignee: Eastman Kodak Company, Rochester, NY (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/159,447

(22) Filed: Sep. 24, 1998

(51) Int. Cl.[7] ..... B41J 2/165
(52) U.S. Cl. ..... 347/28
(58) Field of Search ..... 347/33, 28, 30, 347/22, 27; 134/122 R

(56) References Cited

U.S. PATENT DOCUMENTS

| | | | |
|---|---|---|---|
| 3,373,437 | 3/1968 | Sweet et al. . | |
| 3,416,153 | 12/1968 | Hertz et al. . | |
| 3,705,043 | 12/1972 | Zabiak . | |
| 3,776,642 | 12/1973 | Anson et al. . | |
| 3,846,141 | 11/1974 | Ostergren et al. . | |
| 3,870,528 | 3/1975 | Edds et al. . | |
| 3,878,519 | 4/1975 | Eaton . | |
| 3,889,269 | 6/1975 | Meyer et al. . | |
| 3,903,034 | 9/1975 | Zabiak et al. . | |
| 4,346,387 | 8/1982 | Hertz . | |
| 4,849,769 * | 7/1989 | Dressler | 347/27 |
| 5,005,024 | 4/1991 | Takahashi et al. . | |
| 5,305,015 | 4/1994 | Schantz et al. . | |
| 5,350,616 | 9/1994 | Pan et al. . | |
| 5,426,458 | 6/1995 | Wenzel et al. . | |
| 5,431,722 | 7/1995 | Yamashita et al. . | |
| 5,725,647 | 3/1998 | Carlson et al. . | |
| 5,738,716 | 4/1998 | Santilli et al. . | |
| 5,914,734 * | 6/1999 | Rotering et al. | 347/33 |
| 5,997,127 * | 12/1999 | Fassler et al. | 347/28 |

FOREIGN PATENT DOCUMENTS 2 319 221 A 5/1998 (GB) .

* cited by examiner

*Primary Examiner*—N. Le
*Assistant Examiner*—K. Feggins
(74) *Attorney, Agent, or Firm*—Walter S. Stevens; Roland R. Schindler, II

(57) ABSTRACT

An ink jet printer having an ink jet head and defining a structure having a device including a structure defining a plurality of orifices for ejecting ink droplets includes defining an ink cleaning cavity spaced from the printing position for receiving cleaning fluid; a roller disposed in the cleaning cavity and partially submerged in the cleaning fluid and spaced from the structure is rotated so that the fluid coats the roller and is carried by surface tension around the roller; and the structure is brought into proximity with the cleaning roller so that the orifices are cleaned by the cleaning fluid carried on the roller and delivered through the cleaning cavity to the structure.

25 Claims, 7 Drawing Sheets

Fig. 1
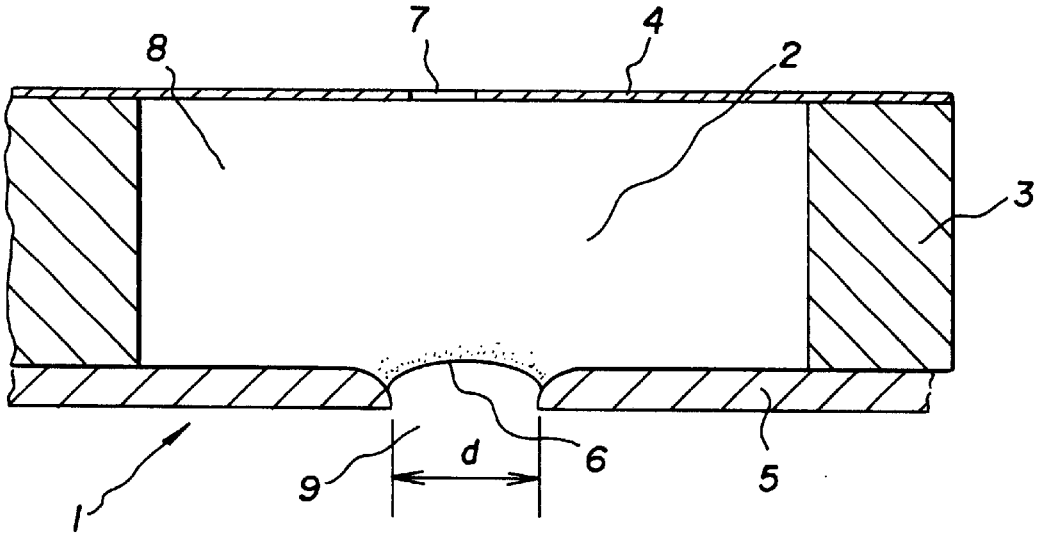
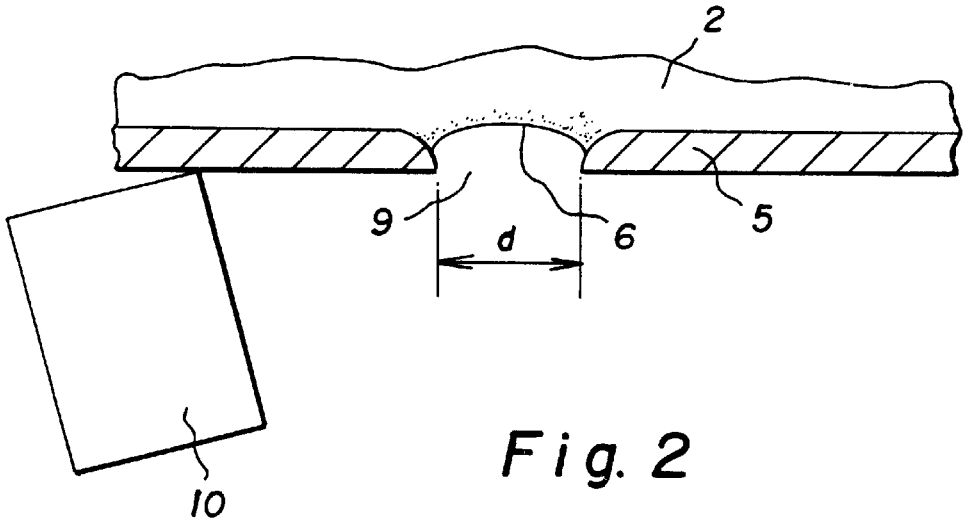
Fig. 2

Fig. 3
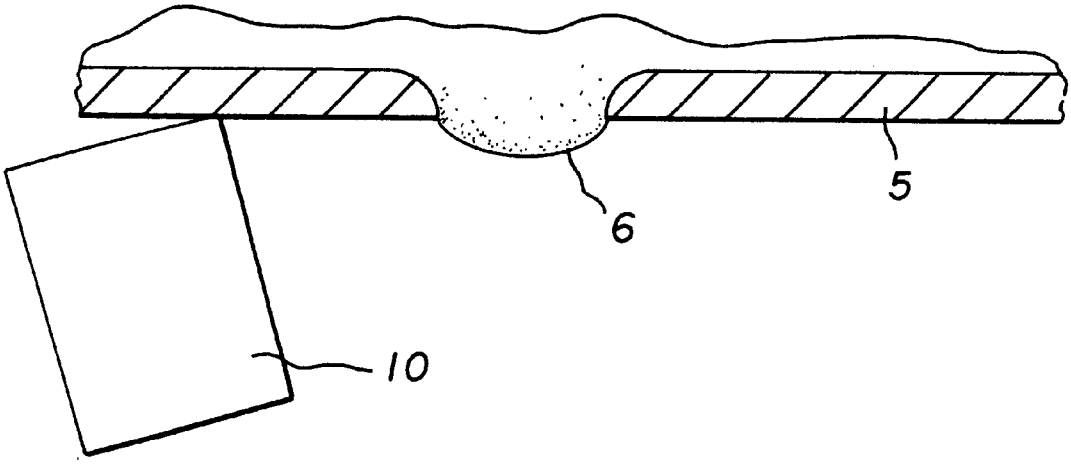
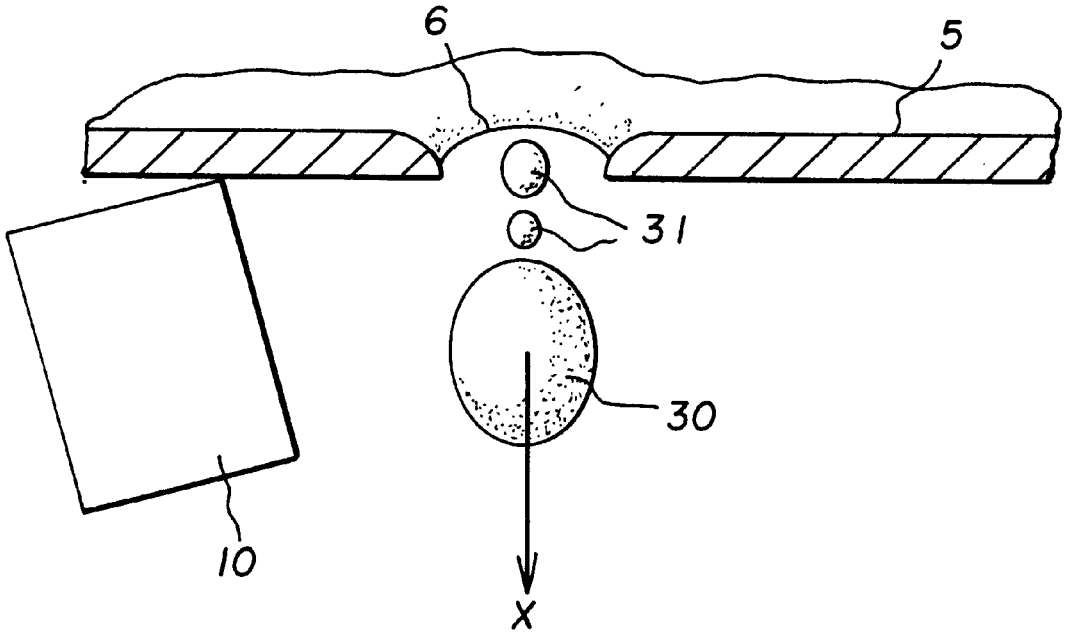
Fig. 4

CLEANING ORIFICES IN INK JET PRINTING APPARATUS

CROSS REFERENCE TO RELATED APPLICATIONS

Reference is made to commonly assigned entitled U.S. Pat. No. 5,997,127 issued on Dec. 7, 1999 "entitiled Adjustable Vane Used in Cleaning Orifices in Inkjet Printing Apparatus" to Werner Fassler et al., the disclosure of which is incorporated herein by reference.

FIELD OF THE INVENTION

This invention relates to the cleaning of ink jet print head apparatus having multiple orifices.

BACKGROUND OF THE INVENTION

Many different types of digitally controlled printing systems of ink jet printing apparatus are presently being used. These ink jet printers use a variety of actuation mechanisms, a variety of marking materials, and a variety of recording media. For home applications, digital ink jet printing apparatus is the printing system of choice because low hardware cost make the printer affordable to every one. Another application for digital ink jet printing uses large format printers. It is a further requirement that these large format printers provide low cost copies with an ever improving quality. Ink jet printing technology is the first choice in today's art. Thus, there is a need for improved ways to make digitally controlled graphic arts media, such as billboards, large displays, and home photos for example, so that quality color images may be made at a high-speed and low cost, using standard or special paper.

Ink jet printing has become recognized as a prominent contender in the digitally controlled, electronic printing arena because of its nonimpact, lownoise characteristics, its use of papers from plain paper to specialized high gloss papers and its avoidance of toner transfers and fixing. Ink jet printing mechanisms can be categorized as either continuous ink jet or droplet on demand ink jet. Continuous ink jet printing dates back to at least 1929. See U.S. Pat. No. 1,941,001 to Hansell.

U.S. Pat. No. 3,373,437, issued to Sweet et al. in 1967, discloses an array of continuous ink jet orifices wherein ink droplets to be printed are selectively charged and deflected towards the recording medium. This technique is known as binary deflection continuous ink jet, and is used by several manufacturers, including Elmjet and Scitex.

U.S. Pat. No. 3,416,153, issued to Hertz et al. in 1966, discloses a method of achieving variable optical density of printed spots in continuous ink jet printing using the electrostatic dispersion of a charged droplet stream to modulate the number of droplets which pass through a small orifice. This technique is used in ink jet printers manufactured by Iris.

U.S. Pat. No. 3,878,519, h issued to Eaton in 1974, discloses a method and apparatus for synchronizing droplet formation in a liquid stream using electrostatic deflection by a charging tunnel and deflection plates.

U.S. Pat. No. 4,346,387, issued to Hertz in 1982 discloses a method and apparatus for controlling the electric charge on droplets formed by the breaking up of a pressurized liquid stream at a droplet formation point located within the electric field having an electric potential gradient. Droplet formation is effected at a point in the field corresponding to the desired predetermined charge to be placed on the droplets at the point of their formation. In addition to charging tunnels, deflection plates are used to actually deflect droplets.

Conventional continuous ink jet utilizes electrostatic charging tunnels that are placed close to the point where the droplets are formed in a stream. In this manner individual droplets may be charged. The charged droplets may be deflected downstream by the presence of deflector plates that have a large potential difference between them. A gutter (sometimes referred to as a "catcher") may be used to intercept the charged droplets, while the uncharged droplets are free to strike the recording medium. If there is no electric field present or if the break off point from the droplet is sufficiently far from the electric field (even if a portion of the stream before droplets break off is in the presence of an electric field), then charging will not occur.

The on demand type ink jet printers are covered by hundreds of patents and describe two techniques for droplet formation. At every orifice, (about 30 to 200 are used for a consumer type printer) a pressurization actuator is used to produce the ink jet droplet. The two types of actuators are heat and piezo materials. The heater at a convenient location heats ink and a quantity will phase change into a gaseous steam bubble and raise the internal ink pressure sufficiently for an ink droplet to be expelled to a suitable receiver. The piezo ink actuator incorporates a piezo material. It is said to possess piezo electric properties if an electric charge is produced when a mechanical stress is applied. This is commonly referred to as the "generator effect" "The converse also holds true; an applied electric field will produce a mechanical stress in the material. This is commonly referred to as the "motor effect". Some naturally occurring materials possessing this characteristics are: quartz and tourmaline. Some artificially produced piezoelectric crystals are: Rochelle salt, ammonium dihydrogen phosphate (ADP) and lithium sulphate (LH). The class of materials used for piezo actuators in an ink jet print head possessing those properties includes polarized piezoelectric ceramics. They are typically referred to as ferroelectric materials. In contrast to the naturally occurring piezoelectric crystals, ferroelectric ceramics are of the "polycrystalline" structure. The most commonly produced piezoelectric ceramics are: lead zirconate titanate, barium titanate, lead titanate, and lead metaniobate. For the ink jet print head a ferroelectric ceramic is machined to produce ink chambers. The chamber is water proofed by gold plating and becomes a conductor to apply the charge and cause the piezo "motor effect". This "motor effect" causes the ink cavity to shrink, raise the internal pressure, and generate an ink droplet.

Inks for high speed jet droplet printers must have a number of special characteristics. Typically, water-based inks have been used because of their conductivity and viscosity range. Thus, for use in a jet droplet printer the ink must be electrically conductive, having a resistivity below about 5000 ohm-cm and preferably below about 500 ohm-cm. For good flow through small orifices water-based inks generally have a viscosity in the range between about 1 to 15 centipoise at 25 degree C.

Over and above this, the ink must be stable over a long period of time, compatible with the materials comprising the orifice plate and ink manifold, free of living organisms, and functional after printing. The required functional characteristics after printing are: smear resistance after printing, fast drying on paper, and waterproof when dry. Examples of different types of water-based jet droplet printing inks are found in U.S. Pat. No. 3,903,034; 3,889,269; 3,870,528; 3,846,141; 3,776,642; and 3,705,043.

The ink also has to incorporate a nondrying characteristic in the jet cavity so that the drying of ink in the cavity is hindered or slowed to such a degree that through occasional spitting of ink droplets the cavities can be kept open. The addition of glycol will facilitate the free flow of ink through the ink jet. Ink jet printing apparatus typically includes an ink jet print head that is exposed to the various environment where ink jet printing is utilized. The orifices are exposed to all kinds of air born particles. Particulate debris accumulates on the surfaces, forming around the orifices. The ink will combine with such particulate debris to form an interference burr to block the orifice or cause through an altered surface wetting to inhibit a proper formation of the ink droplet. That particulate debris has to be cleaned from the orifice to restore proper droplet formation. This cleaning commonly is achieved by wiping, spraying, vacuum suction, and/or spitting of ink through the orifice. The wiping is the most common application.

Inks used in ink jet printers can be said to have the following problems:

1) they require a large amount of energy to dry after printing;
2) large printed areas on paper usually cockle because of the amount of water present;
3) the printed images are sensitive to wet and dry rub;
4) the compositions of the ink usually require an antibacterial preservative to minimize the growth of bacteria in the ink;
5) the inks tend to dry out in and around the orifices resulting in clogging;
6) the wiping of the orifice plate causes wear on plate and wiper;
7) the wiper itself generates particles that clog the orifice;
8) cleaning cycles are time consuming and slow the productivity of ink jet printers. It is especially of concern in large format printers where frequent cleaning cycles interrupt the printing of an image; and
9) when a special printing pattern is initiated to compensate for plugged or badly performing orifices, the printing rate declines.

Some of these problems may be overcome by the use of polar, conductive organic solvent based ink formulations. However, the use of non-polar organic solvents is generally precluded by their lack of electrical conductivity. The addition of solvent soluble salts can make such inks conductive, but such salts are often toxic, corrosive, and unstable.

SUMMARY OF THE INVENTION

It is an object of the invention to provide an ink jet printing apparatus wherein cleaning can be effectively accomplished with a minimum number of parts and operations.

It is another object of this invention to provide for cleaning of ink jet printing apparatus orifices which is accomplished in a minimum time cycle.

It is a further object of the present invention to provide for cleaning a particulate debris thereby eliminating the need of traditional wiper blades.

These objects are achieved by an ink jet printer having a printhead with a source of cleaning fluid and a cleaning member having a surface partially dipped in the cleaning fluid. A first drive mechanism moves the cleaning member surface, creating a continuous flow of cleaning fluid on the surface. A second drive mechanism advances the printhead and the cleaning member surface into a proximate and separate relation, wherein at least one of a plurality of orifices of the printhead enters the continuous flow of fluid.

ADVANTAGES OF THE INVENTION

Rapid cleaning of orifices in accordance with the present invention can be accomplished in such a short time because of the efficiency of cleaning apparatus in accordance with the present invention.

The cleaning fluid on the roller is replenished at a predetermined rate and removes waste ink and particulate debris permanently from the ink jet print head.

Another advantage of this invention is that the cleaning fluid on the roller can have a substantial thickness thereby minimizing the requirements for mechanical tolerances.

Another advantage of this cleaning technique is that with no mechanical rubbing, the wear of the delicate orifice plate is eliminated or greatly reduced. The replacement of the ink jet head will be less frequent and more of the orifices will stay functional to result in a higher image quality.

Another advantage is that individual inks can be cleaned by selecting the rotation rate of the roller to change the turbulence or agitation rate. In this way, the speed of the roller can be selected to match the cleaning needs of a particular ink. In other words, red, green, and blue inks in the same cartridge can have different roller speeds.

BRIEF DESCRIPTION OF THE DRAWINGS

FIG. 1 is a prior art cross sectional schematic view of a typical piezo electric ink jet print head;

FIG. 2 is a schematic showing an ink droplet exit orifice in the FIG. 1 structure and an elastomeric wiper blade commonly used for cleaning the orifice plate;

FIG. 3 the ink droplet as it begins to form in the orifice of FIG. 1;

FIG. 4 shows the ink droplet after formation with the orifice of FIG. 1;

DETAILED DESCRIPTION OF THE INVENTION

Figure 5:
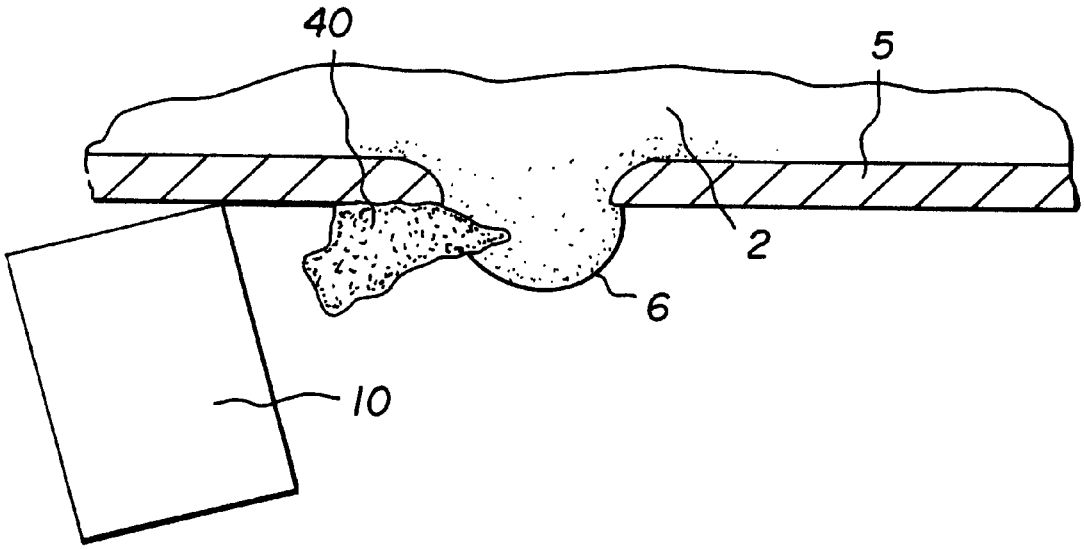
FIG. 5 shows the interference of the particulate debris with the formation of an ink droplet.

FIG. 1 shows a prior art cross sectional view of an ink jet print head 1. Orifices defining structures such as the depicted outlet plate 5 includes orifice 9 having a diameter "d" and can be manufactured by electro-forming or sheet metal fabrication methods. It will be understood that the outlet plate 5 actually includes a plurality of orifices for forming multiple ink droplets. The outlet plate 5 is glued to the piezo walls 3. Ink 2 is included in a pumping cavity 8. An inlet orifice 7 formed in a inlet plate 4 permits ink to be delivered to the pumping cavity 8. A meniscus 6 of ink is formed in the orifice 9.

FIG. 2 shows the outlet plate 5 with the ink outlet meniscus 6 and a elastomeric wiper blade 10 in contact with the outlet orifice plate. The blade is in position to wipe across the diameter "d" of the orifice 9 to clean any ink or other particulate debris that could interfere with the proper functioning of the ink jet print head 1.

FIG. 3 shows the meniscus 6 as it changes from an inward curve to an outward curve during the early stages before an actual ink droplet is manufactured. For reference and clarity the elastomeric wiper blade 10 and the outlet orifice plate 5 are also shown.

FIG. 4 shows the completed ink droplet 30, and its direction which is indicated by the arrow "X". Also shown are (as often is the case when an ink droplet is formed) two ink droplet satellites 31. The formation of satellites 31 is chaotic and can incorporate any number of ink droplet satellites 31 from 0 up to 10. These numbers of satellites 31 have been observed. Note that the outlet meniscus 6 has returned to the original state.

FIG. 5 shows how a debris 40 can interfere with the meniscus 6 during the ink droplet formation. As the ink 2 touches the debris 40, the droplet formation can be completely stopped by the ink surface condition change, due to the presence of the debris 40. Again outlet orifice plate 5 and elastomeric wiper blade 10 are shown for clarity.

Figure 6:
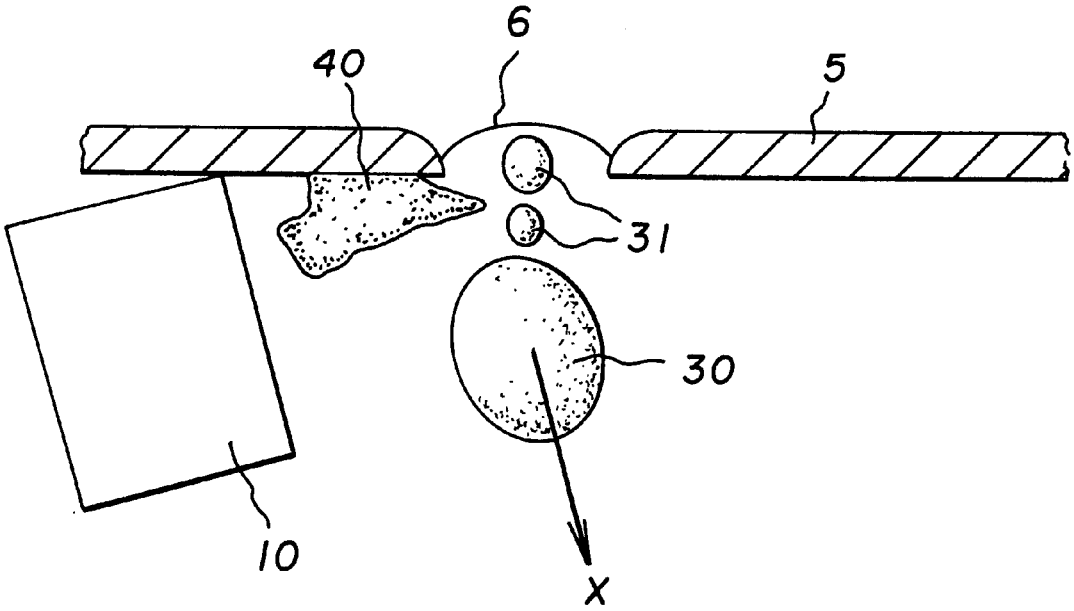
FIG. 6 shows that a particulate material can cause a change of direction of ink droplets.

FIG. 6 shows another defect caused by the presence of a debris 40. The direction of the droplet 30 with satellites 31 shown as "X" is changed and will result in a degradation of the image. Again outlet orifice plate 5 and elastomeric wiper blade 10 are shown for clarity. Note that the outlet meniscus 6 has returned to the original state but debris 40 can also interfere with that process.

Figure 7:
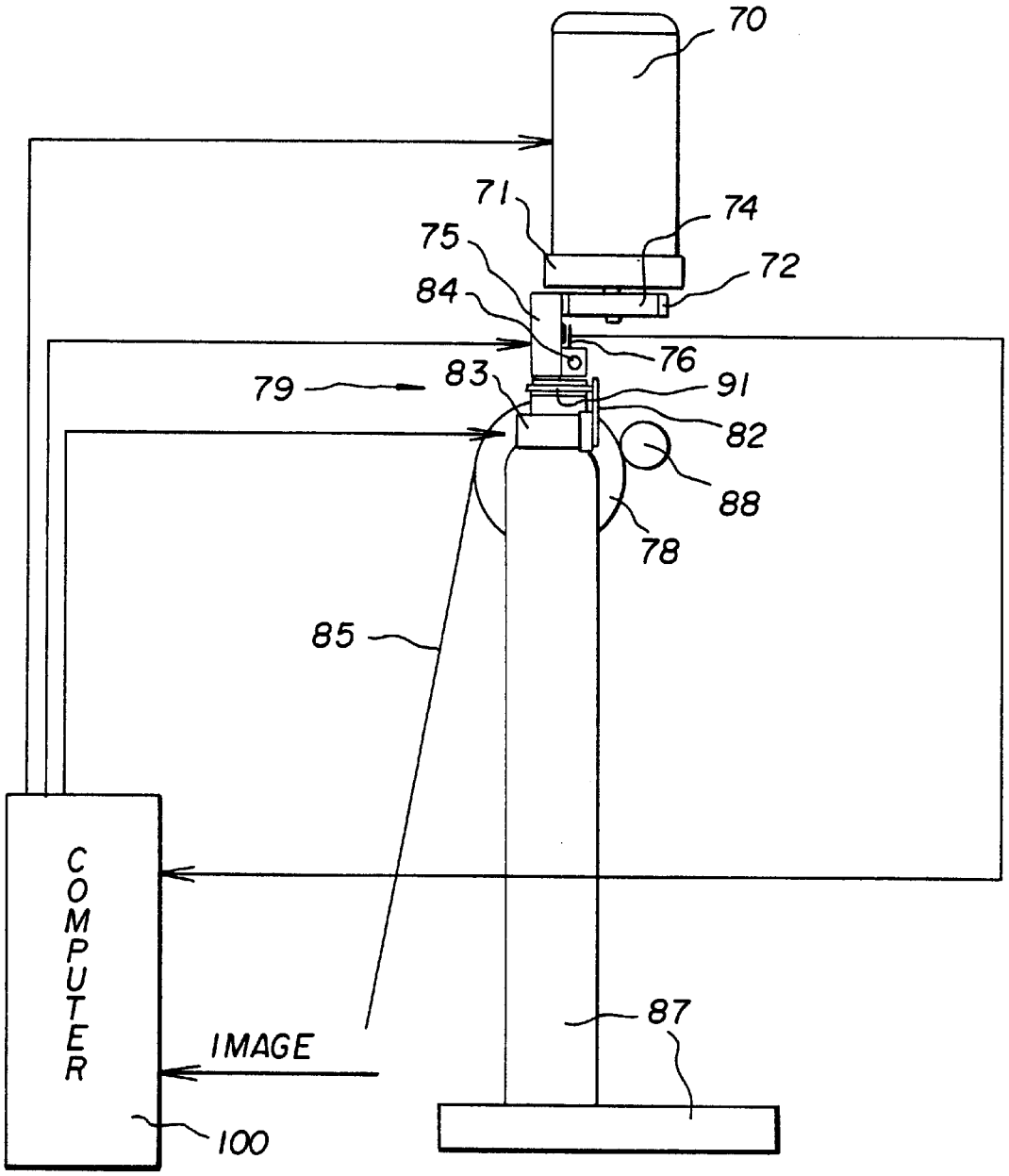
FIG. 7 shows a schematic of ink jet printing apparatus in accordance with the present invention which shows a print head and a cleaning station.

FIG. 7 shows an ink jet printing apparatus 79 in accordance with the present invention, an ink jet head 75, a drive motor 70 linked with a gearbox 71, an ink jet head belt drive wheel 74, and the ink jet head drive belt 72 to drive the ink jet head 75 back and for across the print paper 85. The ink jet droplets are controlled by the position of the ink jet head 75. This position is monitored by a position encoder strip 76 and the image input from computer 100. The same computer controls the ink jet print head 75, drive motor 70, the cleaning roller drive motor 83 which rotates at a desired velocity the cleaning roller 91. Also shown are the guide 84 for back and forth translation of the ink jet head 75. The ink jet generates an image 81(shown in FIG. 8) on the print paper 85. The print paper 85 is supported by the platen roller 78 and registration of the paper is controlled by the capstan roller 88. Both rollers, platen 78 and capstan 88 are driven by a motor not shown and are controlled by the computer 100. Also shown is a cleaning roller 91 with the cleaning roller drive belt 82 connecting the cleaning drive motor 83 to the cleaning roller 91. A mounting structure 87 supports all the associated mechanism for the ink jet printer 79.

Figure 8:
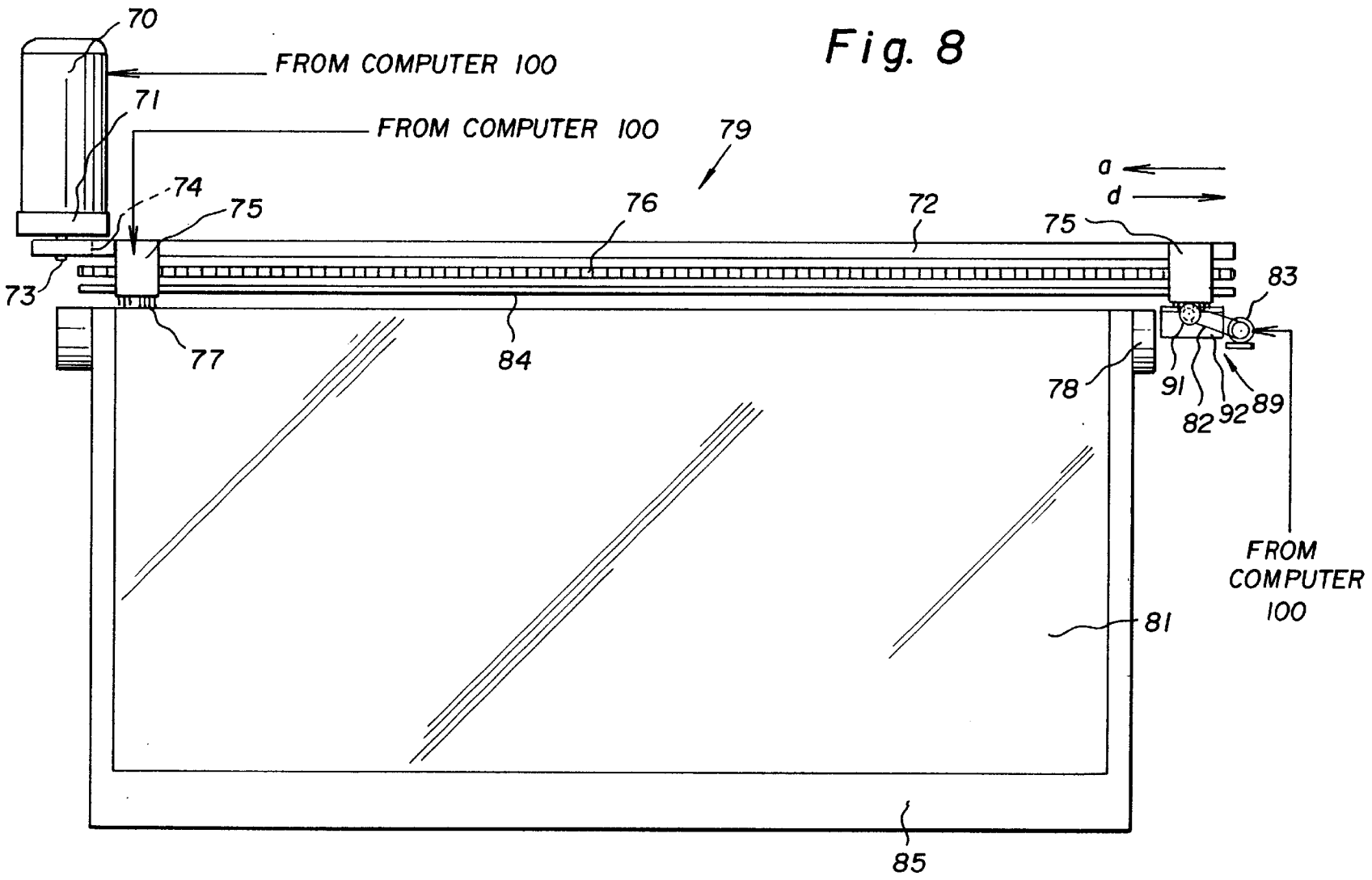
FIG. 8 shows the same as FIG. 7 but a different perspective for clarification of illustration.

FIG. 8 shows the same printer as FIG. 7 but in a 90 degree rotated position. It can now be visualized how the ink jet head 75 with ink droplets 77 move across the paper 85 driven by the ink jet print head drive motor 70, a gearbox 71 to match motor speed with print speed. An ink jet head drive belt 72 driven by the belt drive wheel 74 drives the ink jet print head 75 across the total width of the print paper 85. The position of the print head 75 is metered by the position encoder strip 76. At the right location determined by the computer 100 (shown in FIG. 7) and the encoder strip 76 a ink droplet 77 is deposited to form the image 81. When the ink jet print head 75 reaches the far end of the print paper 85 it de-accelerates in the indicated direction and distance of arrow "d". When reversing' indicated by the direction and distance of arrow "a", the print head 75 re-accelerates to the correct print speed. This turn around deceleration ("d") and re-acceleration ("a") time is used to accomplish the cleaning without added time for the ink jet print head 75. The cleaning station 89 is mounted at the far right side end of the ink jet printer 79 and consists of a cleaning fluid tank 92, a cleaning roller 91, cleaning roller drive motor 83, and a cleaning roller drive belt 82. A number of different cleaning fluids can be used in accordance with the present invention. For example, such fluids can include plain water, distilled water, alcohol or other water miscible solvents, and surfactants such as Zonyl, FSN (duPont). See also the disclosure of the above referenced commonly assigned U.S. patent application Ser. No. 09/159,979 filed concurrently herewith, now U.S. Pat. No. 5,997,127, entitled "Adjustable Vane Used in Cleaning Orifices in Inkjet Printing Apparatus" to Werner Fassler et al., the disclosure of which is incorporated herein by reference.

Figure 9:
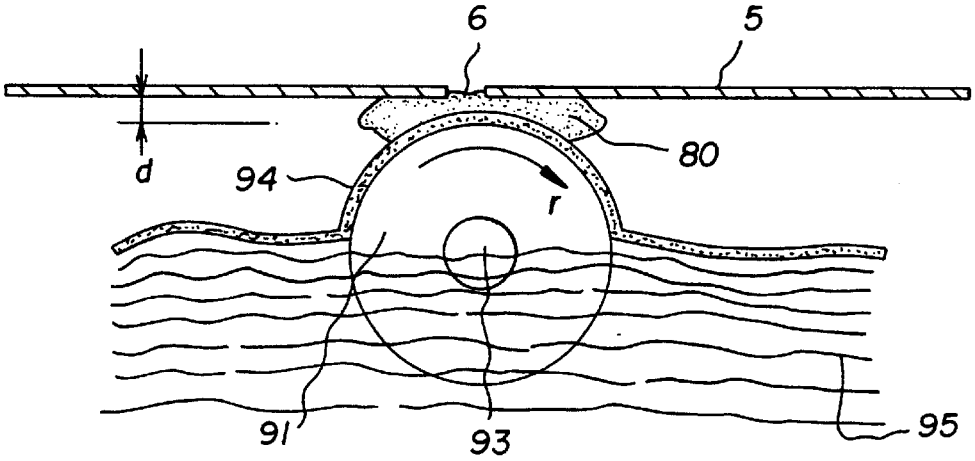
FIG. 9 shows the cleaning mechanism in accordance with the present invention.

FIG. 9 shows the rotating cleaning roller 91 mounted to a shaft 93 is partially submerged in the cleaning fluid and spaced from the structure defining the orifices 9. The cleaning roller 91, as it rotates, carries by surface tension a coating 94 of cleaning liquid 95 to the outlet orifice plate 5. The roller or the roller surface is made from a material which can be surface coated by the cleaning fluid. Such roller surface material can be selected from the group consisting of aluminum, teflon, polyvinyl chloride, stainless steel, glass, and titanium. The liquid will fill the cleaning cavity 80. The liquid surface friction between the stationary outlet orifice plate 5 and the rotating cleaning roller 91 will cause a great amount of turbulence and liquid shearing to remove dirt and ink from the outlet orifice plate 5 in and near the orifices 6. An arrow marked "r" indicates one of the possible two the rotational direction of the cleaning roller 91.

Figure 10:
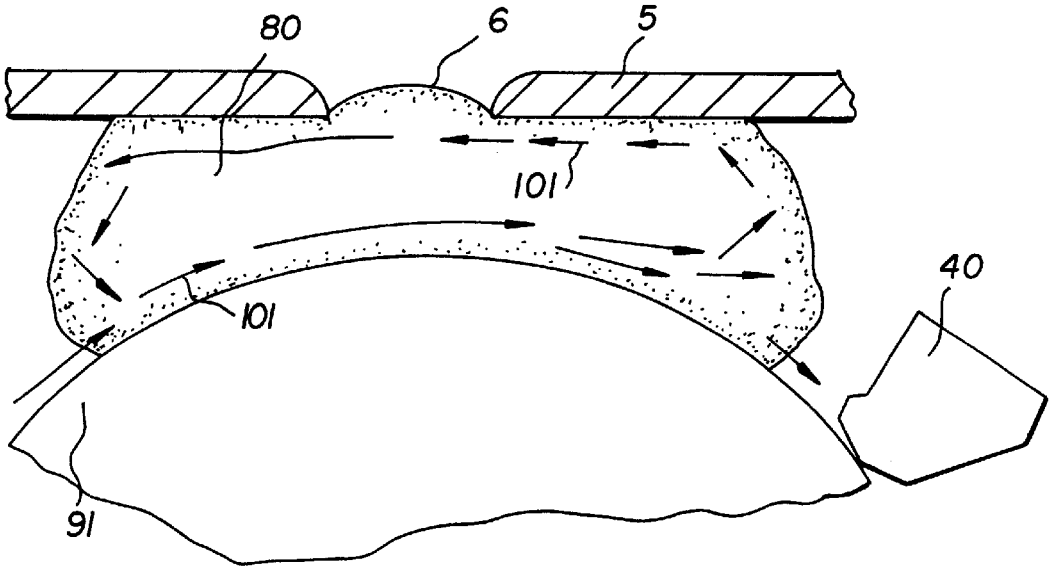
FIG. 10 shows an enlargement of the cleaning fluid coating depicting its turbulent counter clockwise flow.

FIG. 10 shows in an enlarged form how the fluid friction shown by vectors 101 causes the flow of the cleaning fluid to shear dirt and other particles 40 permanently from the outlet orifice plate 5. The vectors 101 indicate the flow of fluid in the cleaning cavity 80 caused by surface friction of orifice plate 5 and cleaning roller 91.

Figure 11:
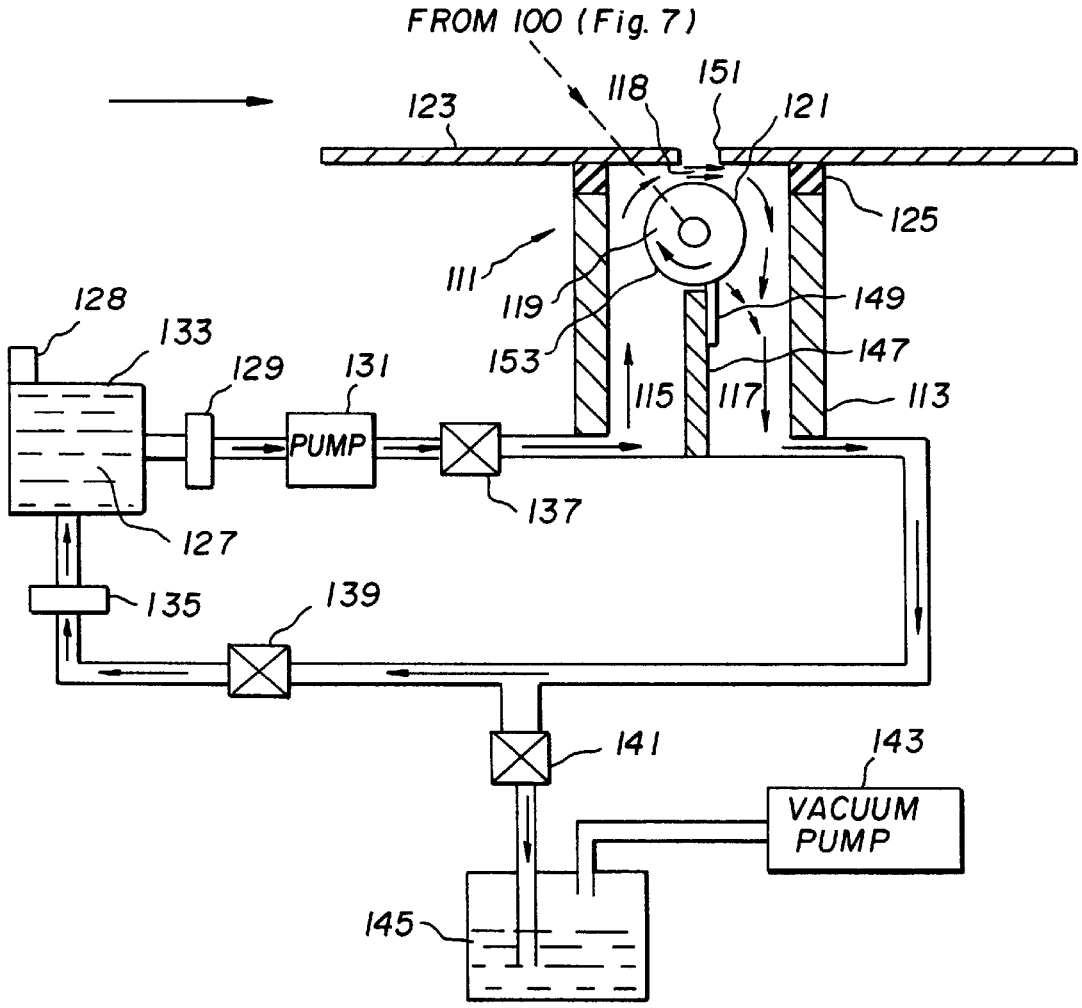
FIG. 11 shows a schematic view of another embodiment of the present invention which depicts an ink jet print head and a head cleaning device.

FIG. 11 shows another embodiment of the invention cleaning an ink jet print head. The ink jet print head has moved (see arrows) from the print position (not shown) to a cleaning position. The head cleaning device 111 includes a cleaning liquid collection vessel 113, cleaning liquid supply 115 and exit 117 channels, and a rotating cleaning roller 119 mounted onto a shaft 121. A wall 147 separates the channels 115 and 117. Cleaning head 111 is brought into contact with outlet orifice plate 123 and a leak-proof seal is created by elastomer 125 at bottom of cleaning head 111. The outlet orifice plate 123 has a plurality of orifices of which only one orifice 151 is shown. Cleaning liquid 127 is pumped from cleaning liquid reservoir 133 into cleaning liquid supply channel 115 (by pump 131 with valves 137 and 139 in the open position and valve 141 in the closed position). Cap and vent 128 is provided on the reservoir 133. The head cleaning device 111 is substantially filled with cleaning liquid 127. Cleaning roller 119 (driven "by a cleaning roller drive motor (not shown) controlled" by computer 100 shown in FIG. 7) is rotated at the desired rotation rate. The rotation of the cleaning roller creates shear forces in the gap 118, thus producing a cleansing/scrubbing action capable of dislodging particles and/or debris accumulating around ink jet orifices. The size of gap 118 is controlled by the location of the cleaning roller, the diameter of the cleaning roller and the thickness of the elastomer seal 125. The dislodged debris is carried away by the cleaning liquid exiting in exit channel 117. However, particles and fibers may adhere to rotating cleaning roller 119, in which case the contaminated rotating cleaning roller 119 will most likely abrade outlet orifice plate 123. In order to minimize this, a scraper blade 149 attached to the roller end of wall 147 and in contact with cleaning roller 119 removes particles adhering to the roller and also prevents particles form entering the supply channel 115. It is preferred but not necessary that the scraper be flexible and in contact with cleaning roller 119. The exiting cleaning liquid preferably is re-circulated. A filter 129 interposed between the cleaning liquid reservoir 133 and pump 131 ensures that cleaning liquid entering the supply channel 115 is free of particles and fibers. A second filter 135 is also preferably used to filter cleaning liquid from exit channel 117 before entering reservoir 133. The cleaning liquid is fed into device 111 at a steady rate by pump 131. At a desired time, pump 131 is turned off and valve 139 is closed. Valve 137 (a 3-way valve) is positioned so that it is open to atmosphere only. Vacuum pump 143 is activated and valve 141 is opened to suck trapped cleaning liquid between valves 137 and 139 into collection receptacle 145. This operation prevents spillage of cleaning liquid when the device 111 is detached from outlet orifice plate 123. Further, the outlet orifice plate 123 is substantially dry, permitting the ink jet print head to function without impedance from liquid drops around the orifices. Cleaning liquid in collection receptacle 145 may be poured back into cleaning liquid reservoir 133 or can be pumped back into cleaning liquid reservoir 133 (pump and piping is not shown).

Although the cleaning roller surface 153 is shown spaced from the plate 123, it can be in direct contact with plate. In such a case the roller surface 153 should be formed of a soft absorbent material such as porous elastomeric material which can carry cleaning liquid 127. In this case it is preferable that the scraper blade 149 presses against the roller surface 153 so that cleaning fluid and debris is squeezed out of the porous roller surface 153. For this purpose, it is preferable that the scraper blade 149 be constructed out of a stiff material made of plastic.

It is understood that the device 111 would function without wall 147 and scraper blade 149. In this case however, channels 115 and 117 would be combined to create one chamber with an inlet and an out let for the cleaning solution. This modification to head cleaning device 111 is not shown. The head cleaning device 111 will also function if the device is primed with cleaning liquid and connected to a cleaning liquid reservoir. When the cleaning roller rotates, cleaning liquid is siphoned from cleaning solution reservoir and pumped through device 111. The cleaning roller therefore has a dual function in that it cleans the outlet orifice plate 123 and also acts as a pump. This embodiment is not shown. The device 111 may also be configured to utilize a variety of cleaning liquids by incorporating appropriate valves and plumbing (not shown).

The invention has been described in detail, with particular reference to certain preferred embodiments thereof, but it should be understood that variations and modifications can be effected with the spirit and scope of the invention.

PARTS LIST

1 ink jet print head
2 ink
3 piezo material
4 inlet plate
5 outlet plate
6 outlet meniscus
7 inlet orifice
8 pumping cavity
9 outlet orifice
10 elastomeric wiper blade
30 ink droplet
31 satellite
40 debris as particles
70 ink jet head drive motor
71 gearbox
72 ink jet head drive belt
74 drive wheel
75 ink jet head
76 encoder strip
77 ink droplets
78 platen roller
79 ink jet printer
80 cavity space
81 image
82 cleaning roller drive belt
83 cleaning roller drive motor
84 guide
85 print paper
87 mounting structure
88 capstan roller
89 cleaning station
91 cleaning roller
92 cleaning fluid tank
93 shaft
94 surface coating
95 cleaning liquid
100 computer
101 vectors
111 head cleaning device
113 cleaning liquid collection vessel
115 cleaning liquid supply channel
116 cleaning liquid exit channel
117 exit channel
118 gap
119 rotating cleaning roller
121 shaft
123 outlet orifice plate
125 elastomer
127 cleaning liquid
128 cap and vent
129 first filter
131 pump
133 cleaning liquid reservoir
135 second filter
137 first valve, 3-way valve
139 second valve
141 third valve
143 vacuum pump
145 collection receptacle
147 wall
149 scraper blade
151 orifice
153 cleaning roller surface

What is claimed is:

1. An ink jet printer having a printhead defining a plurality of orifices for ejecting ink droplets, said printer comprising:

a source of cleaning fluid;

a cleaning member having a surface partially dipped in the cleaning fluid;

a first drive mechanism to move the cleaning member surface creating a flow of cleaning fluid on the surface; and a second drive mechanism to advance the printhead and the cleaning member surface into a proximate and separate relation wherein at least one of the orifices of the printhead enter flow of cleaning fluid.

2. The inkjet printer of claim 1 wherein the proximate and separate relation is defined so that at least one of the orifices are entered into the flow of fluid to disrupt the flow of cleaning fluid in a manner that creates a turbulent flow about the at least one orifice.

3. The ink jet printer of claim 1 wherein the cleaning member is a rotating roller.

4. The inkjet printer of claim 3 wherein the roller surface is selected from the group consisting of aluminum, teflon, polyvinyl chloride, stainless steel, glass and titanium.

5. The inkjet printer of claim 1 wherein the surface is made from a material which can be surface coated by the cleaning fluid.

6. The inkjet printer of claim 1 wherein the surface is selected from the group consisting of aluminum, teflon, polyvinyl chloride, stainless steel, glass and titanium.

7. The inkjet printer of claim 1 wherein said second drive mechanism advances the printhead relative to the surface so that selected ones of the orifices of the printhead are entered into the flow of cleaning fluid.

8. The inkjet printer of claim 1 wherein said second drive mechanism also advances the surface relative to the printhead so that the flow of cleaning fluid is advanced to create a flow of cleaning fluid about selected ones of the orifices of the printhead.

9. The inkjet printer of claim 1 further comprising an exit channel and wherein the moving cleaning member surface causes cleaning fluid to flow into the exit channel.

10. An inkjet printer having a printhead and including a structure defining a plurality of ink drop ejection orifices, comprising:

a liquid collection vessel adapted to contain a cleaning fluid;

a roller partially submerged in the cleaning fluid;

a first motor fixed to and rotating the roller to create a flow of cleaning fluid about the roller; and a second motor to variably position the roller and the printhead between two separated positions, a distal position and a proximate position wherein at least one orifice of the printhead enters into the flow of cleaning fluid.

11. The printer of claim 10 wherein said proximate position is defined to introduce the at least one orifice into the flow of cleaning fluid so as to create turbulent flow about at least one orifice.

12. The printer of claim 10 wherein said proximate position is defined by a stop that prevents advancing the printhead into contact with the roller.

13. The printer of claim 10 further comprising a used cleaning fluid chamber disposed proximate to the liquid collection vessel.

14. The printer of claim 13 further comprising a blade in communication with the roller for separating used cleaning fluid from the roller and directing the used cleaning fluid into the used cleaning fluid chamber.

15. The ink jet printer of claim 10 wherein the surface is made from a material which can be surface coated by the cleaning fluid.

16. The ink jet printer of claim 10 wherein the roller surface material is selected from the group consisting of aluminum, teflon, polyvinyl chlorine, stainless steel, glass, and titanium.

17. An inkjet printer having an printhead defining a plurality of orifices for ejecting ink droplets, comprising:

a) means defining an ink cleaning cavity spaced from the printing position for receiving cleaning fluid;

b) a surface disposed in the cleaning cavity and partially submerged in the cleaning fluid and spaced from the printhead;

c) means for moving the surface to draw a flow of cleaning fluid across the moving surface; and d) means for bringing the printhead orifices into a proximate and separate relation to the moving surface so that the orifices are injected into the flow of cleaning fluid and are cleaned by the cleaning fluid.

18. The ink jet printer of claim 17 wherein the means for bringing the structure into a proximate and separate relation with the moving surface to create a turbulence of the cleaning fluid about at least one orifice.

19. The ink jet printer of claim 17 wherein the surface is made from a material which can be surface coated by the cleaning fluid.

20. The ink jet printer of claim 17 wherein the roller surface material is selected from the group consisting of aluminum, teflon, polyvinly chlorine, stainless steel, glass, and titanium.

21. An ink jet printer having a print head defining a plurality of orifices for ejecting ink droplets, said printer comprising:

a supply of cleaning fluid;

a cleaning surface in partial contact with the supply of cleaning fluid;

a first drive mechanism to rotate the cleaning surface so that the rotation of the cleaning surface impels cleaning fluid from the supply to form a flow of cleaning fluid about the cleaning surface;

a second motor to variably position the cleaning surface and the print head between two separated positions, a distal position and a proximate position wherein at least one orifice of the print head enters into the flow of cleaning fluid.

22. The inkjet printer of claim 21 wherein the proximate and separate relation is defined so that at least one of the orifices are entered into the flow of fluid to disrupt the flow of cleaning fluid in a manner that creates a turbulent flow about the at least one orifice.

23. The ink printer of claim 21 wherein the cleaning surface is a rotating roller.

24. The inkjet printer of claim 21 wherein second drive mechanism advances the print head relative to the surface so that selected ones of the orifices of the print head are entered into the flow of cleaning fluid.

25. The inkjet printer of claim 21 further comprising an exit channel wherein the moving cleaning member surface impels cleaning fluid to flow from the cleaning fluid source across the cleaning member surface and into the exit channel.

* * * * *